US010270185B2

(12) United States Patent
Boutayeb et al.

(10) Patent No.: US 10,270,185 B2
(45) Date of Patent: Apr. 23, 2019

(54) SWITCHABLE DUAL BAND ANTENNA ARRAY WITH THREE ORTHOGONAL POLARIZATIONS

(71) Applicants: Halim Boutayeb, Ottawa (CA); Paul Robert Watson, Ottawa (CA)

(72) Inventors: Halim Boutayeb, Ottawa (CA); Paul Robert Watson, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 82 days.

(21) Appl. No.: 15/383,468

(22) Filed: Dec. 19, 2016

(65) Prior Publication Data

US 2018/0175515 A1 Jun. 21, 2018

(51) Int. Cl.

| | |
|---|---|
| ***H01Q 1/24*** | (2006.01) |
| ***H01Q 5/30*** | (2015.01) |
| ***H01Q 9/16*** | (2006.01) |
| ***H01Q 15/14*** | (2006.01) |
| ***H01Q 21/24*** | (2006.01) |

(52) U.S. Cl.

CPC ..... *H01Q 21/245* (2013.01); *H01Q 1/24* (2013.01); *H01Q 5/30* (2015.01); *H01Q 9/16* (2013.01); *H01Q 15/14* (2013.01)

(58) Field of Classification Search

CPC ..... H01Q 5/30; H01Q 21/245; H01Q 21/26

See application file for complete search history.

(56) References Cited

U.S. PATENT DOCUMENTS

| | | | | |
|---|---|---|---|---|
| 9,548,544 | B2 | 1/2017 | Watson et al. | |
| 2006/0114168 | A1* | 6/2006 | Gottl ..... | H01Q 1/246 343/797 |

(Continued)

FOREIGN PATENT DOCUMENTS

| | | |
|---|---|---|
| CN | 202712437 U | 1/2013 |
| CN | 103545621 A | 1/2014 |

OTHER PUBLICATIONS

"ZoneFlex R710 Dual-Band 4×4:4 802.11ac Smart Wi-Fi AP Data Sheet", 2016 Ruckus Wireless, Inc. Company Proprietary Information, 4 pages.

(Continued)

*Primary Examiner* — Daniel Munoz

(57) ABSTRACT

A radio frequency (RF) antenna array that includes a first antenna unit that operates at a first frequency band and includes three antenna elements that are collocated on a reflector element, each of the three antenna elements having a different polarization direction than the other two antenna elements of the first antenna unit. A first switch is associated with the first antenna unit and a first conductive line for selectively connecting each one of the antenna elements of the first antenna unit to the first conductive line. A second antenna unit that operates at a second frequency band also includes three antenna elements that are collocated on the reflector element, each of the three antenna elements having a different polarization direction than the other two antenna elements of the second antenna unit. A second switch is associated with the second antenna unit and a second conductive line for selectively connecting each one of the antenna elements of the second antenna unit to the second conductive line.

21 Claims, 13 Drawing Sheets

(56) References Cited

U.S. PATENT DOCUMENTS

| | | | | |
|---|---|---|---|---|
| 2006/0192720 | A1* | 8/2006 | Shtrom ..... | H01Q 1/38 343/795 |
| 2009/0135078 | A1 | 5/2009 | Lindmark et al. | |
| 2011/0122039 | A1 | 5/2011 | Baba et al. | |
| 2012/0280879 | A1 | 11/2012 | Zimmerman et al. | |
| 2014/0368395 | A1 | 12/2014 | Dauguet et al. | |

OTHER PUBLICATIONS

"Adant/Advancing Antenna Technology", http://www.adant.com/technology, 5 pages.
"Adant/Advancing Antenna Technology", http://ww.adant.com, 2 pages.
U.S. Appl. No. 14/745,421, filed Jun. 20, 2015, entitled "Antenna Element for Signals with Three Polarizations".

* cited by examiner

SWITCHABLE DUAL BAND ANTENNA ARRAY WITH THREE ORTHOGONAL POLARIZATIONS

TECHNICAL FIELD

The present disclosure relates to dual band antenna arrays with three orthogonal polarizations.

BACKGROUND

Base station antennas are often mounted in high traffic metropolitan areas. As a result, compact antenna modules are favored over bulkier ones because compact modules are aesthetically pleasing (e.g., less-noticeable) as well as easier to install and service. Many base station antennas deploy arrays of antenna elements to achieve advanced antenna functionality, e.g., beamforming, etc. Accordingly, techniques and architectures for reducing the profile of individual antenna elements as well as for reducing the size (e.g., width, etc.) of the antenna element arrays are desired, while maintaining key performance features such as polarization diversity.

SUMMARY

Existing antennas face challenges in respect of the number of radio frequency streams, polarizations and frequency bandwidths they can effectively support within a compact antenna package. Examples described herein can in at least some applications address one or more of these challenges. In at least some examples, an antenna configuration is provided that can support different frequency bands with multiple antenna units, each of which provide selectable polarization diversity. One example aspect is a radio frequency (RF) antenna array that includes a first antenna unit that operates at a first frequency band and includes three antenna elements that are collocated on a reflector element, each of the three antenna elements having a different polarization direction than the other two antenna elements of the first antenna unit. A first switch is associated with the first antenna unit and a first conductive line for selectively connecting each one of the antenna elements of the first antenna unit to the first conductive line. A second antenna unit that operates at a second frequency band also includes three antenna elements that are collocated on the reflector element, each of the three antenna elements having a different polarization direction than the other two antenna elements of the second antenna unit. A second switch is associated with the second antenna unit and a second conductive line for selectively connecting each one of the antenna elements of the second antenna unit to the second conductive line.

In some example configurations, the antenna array includes a plurality of the first antenna units, and a plurality of the first switches, each of the first switches being associated with a respective one of the first antenna units and a respective first conductive line. In such configurations, the antenna array also includes a plurality of the second antenna units, and a plurality of the second switches, each of the second switches being associated with a respective one of the second antenna units and a respective second conductive line. Each of the three antenna elements in each of the first and second antenna units has a polarization direction for emitting or receiving RF signals that is orthogonal to a polarization direction of the other two antenna elements. In some embodiments, the first antenna units alternate with second antenna units around a central area of the reflector element. The first and second antenna units may be generally symmetrically located around the central area.

In some example configurations of the antenna array, the first and second antenna units are each disposed on a first surface of the reflector element and the first switches and second switches are each disposed on a second surface that faces an opposite direction than the first surface, the second surface having a plurality of interfaces disposed thereon connecting the first and second conductive lines to the first and second switches. At least some of the first antenna units may have different polarization orientations on the reflector element than at least some of the other first antenna units. In some examples, the first frequency band is a 2.4 GHz band and the second frequency band is a 5 GHz band.

In some configurations of the antenna array, the antenna elements of each of the first antenna unit and the second antenna unit include a first dipole antenna element, a second dipole antenna element, and a monopole antenna element. The first dipole antenna element, second dipole antenna element and monopole antenna element intersecting at a common antenna unit axis. In some examples, the first dipole antenna element and the second dipole antenna element are polarized in orthogonal directions generally parallel to the reflector element, and the monopole antenna element is polarized in a direction that is orthogonal to the reflector element.

Another example aspect is a radio frequency (RF) antenna apparatus that includes a reflector element, a set of first interface elements disposed on the reflector element for exchanging RF signals with conductive wires, and a set of first antenna units that operate at a first frequency band disposed on the reflector element. Each first antenna unit being associated with a respective one of the first conductive lines and comprising three intersecting antenna elements that: (i) are each individually connectable to the first conductive line associated with the first antenna unit; and (ii) each have a polarization direction that is orthogonal to polarization directions of the other two antenna elements. The apparatus also includes a set of second interface elements disposed on the reflector element for exchanging RF signals with conductive wires, and a set of second antenna units that operate at a second frequency band disposed on the reflector element, each second antenna unit being associated with a respective one of the second conductive lines and comprising three intersecting antenna elements that: (i) are each individually connectable to the second conductive line associated with the second antenna unit; and (ii) each have a polarization direction that is orthogonal to polarization directions of the other two antenna elements.

In some examples, the first antenna units alternate with second antenna units around a central area on a first surface of the reflector element, and the first and second interface elements are disposed on a second surface that faces an opposite direction than the first surface. In some applications, the first antenna units may all have different polarization orientations on the reflector element than the other first antenna units and the second antenna units may all have the same polarization orientation on the reflector element.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

System operators require more and more capacity for multiple input and multiple output (MIMO) antennas. One way to increase the capacity of such a system is to provide an antenna array that includes multiple antenna units that support dual bands with three orthogonal polarizations directions.

Figure 1:
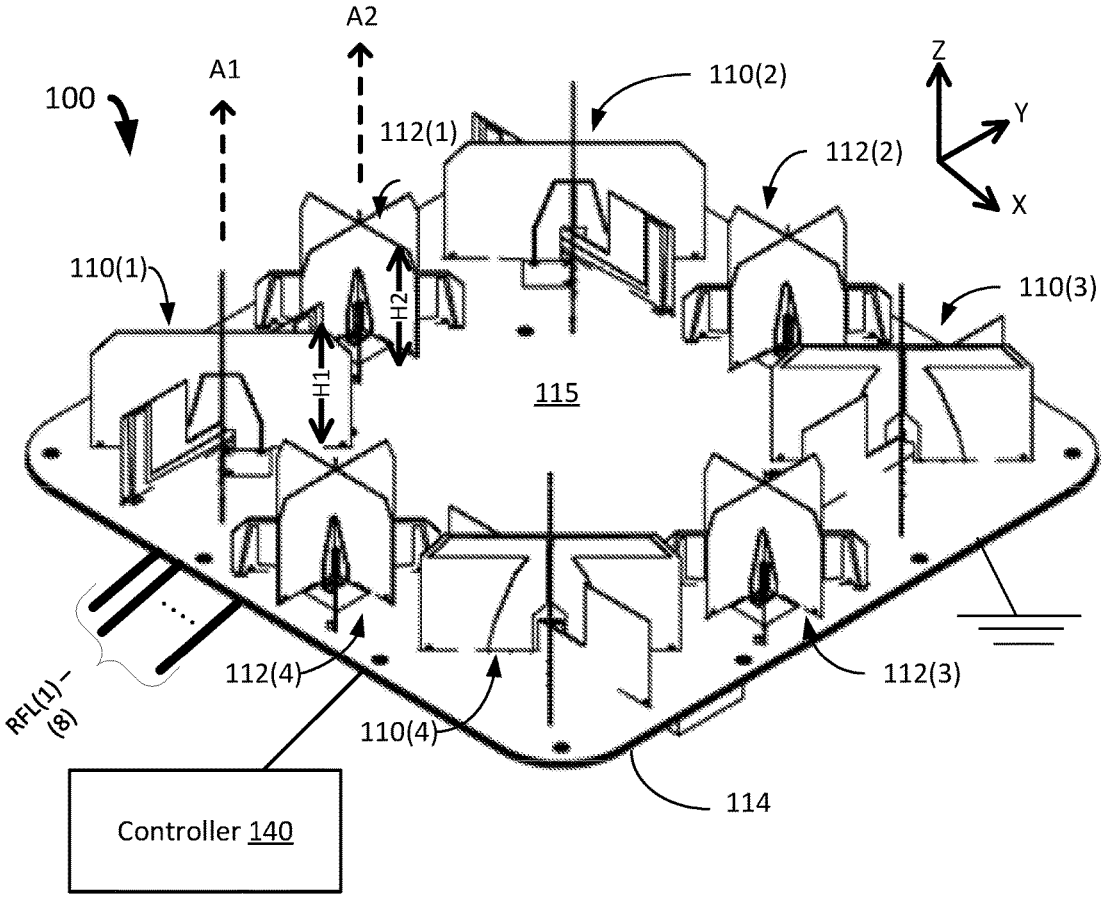
FIG. 1 is a perspective view of an antenna array according to example embodiments.
Figure 2:
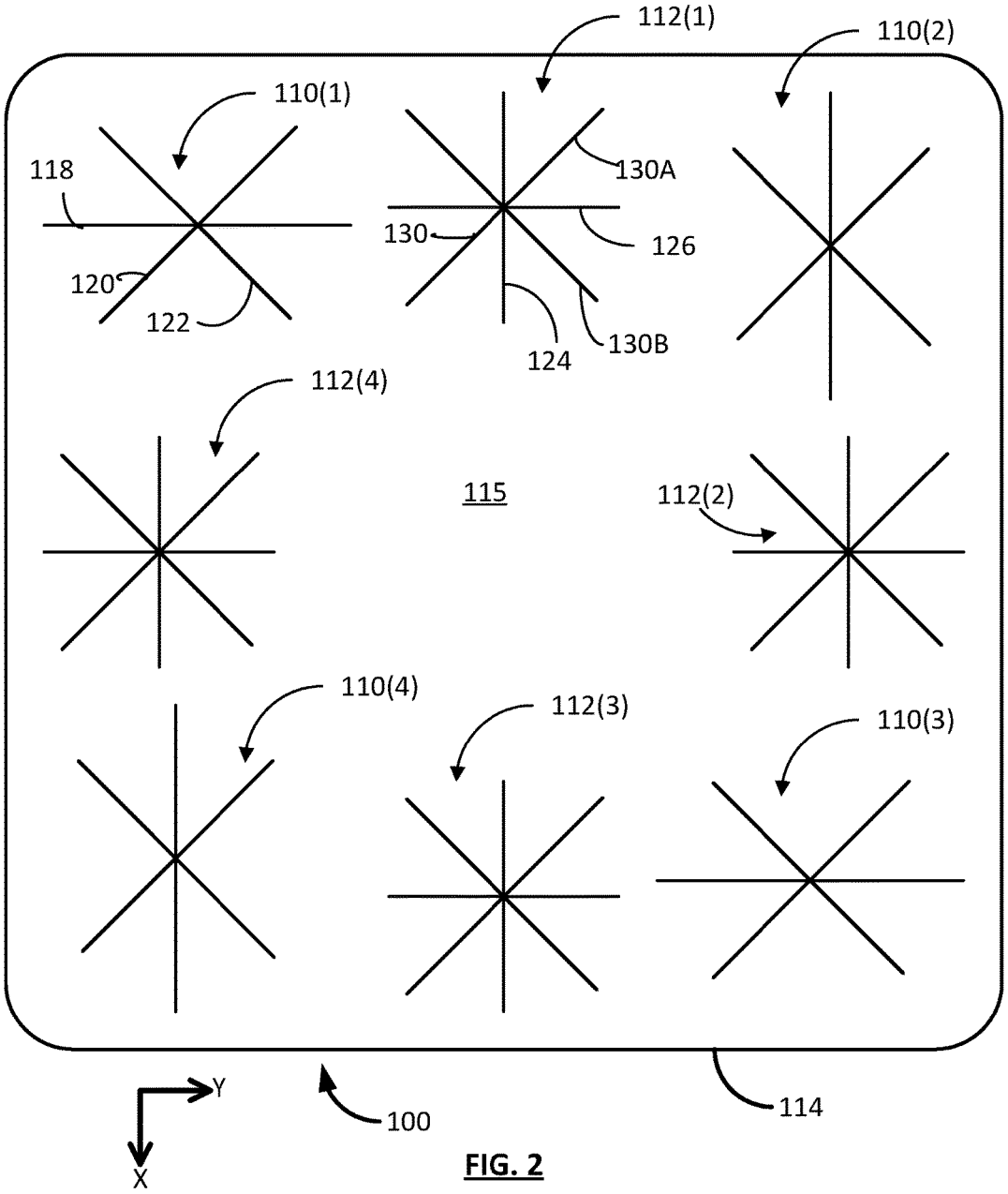
FIG. 2 is a top plan view of the antenna array of FIG. 1.

FIGS. 1 and 2 illustrate perspective and top views of a switchable dual band antenna array 100 with three orthogonal polarizations, in accordance with example embodiments. The antenna array 100 includes a planar reflector element 114 that supports a set of first antenna units 110(1) to 110(4) (referred to generically as first antenna units 110) and a set of second antenna units 112(1) to 112(4) (referred to generically as antenna units 112). The antenna units 110 and 112 all extend from the same side (referred to herein as the front surface 115) of the reflector element 114 and are symmetrically arranged in alternating fashion around a central area of the front surface 115 of reflector element 114. In an example embodiment the reflector element 114 is a multi-layer printed circuit board (PCB) that includes a conductive ground plane layer with a ground connection, one or more dielectric layers, and one or more layers of conductive traces for distributing control and power signals throughout the reflector element 114. By way of non-limiting example, in one possible configuration the reflector element is a 200 mm by 200 mm square, although several other shapes and sizes are possible.

In example embodiments the first antenna units 110 are configured to emit or receive wireless radio frequency (RF) signals within a first RF band and the second antenna units 112 are configured to emit or receive radio wireless frequency (RF) signals within a second RF band. For example, in some embodiments the antenna 100 is used to support WiFi communications, with the first antenna units 110 configured to operate in the 2.4 GHz frequency band and the second antenna units 112 configured to operate in the 5 GHz frequency band.

In the illustrated example, the antenna array includes four 2.4 GHz antenna units 110(1) to 110(4), positioned at the four corners of the reflector element 114, and four 5 GHz antenna units 112(1) to 112(4). The 5 GHz antenna units 112 are each located between a pair of 2.5 GHz antenna units about the perimeter of the reflector element—for example 5 GHz antenna unit 112(1) is located between 2.5 GHz antenna units 110(1) and 110(2), 5 GHz antenna unit 112(2) is located between 2.5 GHz units 110(2) and 110(3), and so on as illustrated in FIGS. 1 and 2. In different example embodiments, the number of antenna units operating at each frequency band could be less than or greater than 4, and the relative locations and orientations could be different than that shown in the Figures. Furthermore the operating frequency bands could be different than the 2.4 GHz and 5 GHz bands that are referenced herein.

Each 2.4 GHz antenna unit 110 includes three collocated, electrically isolated antenna elements 118, 120 and 122 that are disposed on reflector element 114 and that intersect with each other at a central antenna unit axis A1 that is normal to the reflector element 114 (e.g. the axis A1 extends in the vertical Z direction in the coordinate system illustrated in the Figures). Antenna elements 120 and 122 are first and second dipole-type antennas that are rotated 90 degrees with respect to each other about the common central antenna unit axis A1, and the antenna element 118 is a monopole-type antenna that symmetrically bisects the dipole antenna elements 120, 122. The three antenna elements provide three orthogonal polarizations, with the first and second dipole type antenna elements 120, 122 being configured to emit or receive RF signals in the horizontal X-Y plane in polarization directions that are directed at 90 degrees relative to each other, and the monopole type antenna element 118 being configured to emit or receive RF signals polarized in the vertical Z direction. Thus, first dipole antenna element 120 and the second dipole antenna element 122 are polarized in orthogonal directions generally parallel to the reflector element 114 and the monopole antenna element 118 is polarized in a direction that is orthogonal to the reflector element 114.

In the embodiment shown in FIGS. 1 and 2, each of the four 2.4 GHz antenna units 110(1) to 110(4) has a different orientation on the reflector element 114. In one example, the second 2.4 GHz antenna unit 110(2) is rotated 90 degrees about its vertical axis relative to the first 2.4 GHz antenna unit 110(1), the third 2.4 GHz antenna unit 110(3) is rotated 90 degrees relative to the second 2.4 GHz antenna unit 110(2), and the fourth 2.4 GHz antenna unit 110(4) is rotated 90 degrees relative to the third 2.4 GHz unit 110(3). Accordingly, in example embodiments each individual antenna unit 110 includes multiple polarization options, and further polarization options are provided between the different antenna units 110(1) to 110(4). In some examples, at least some of the antenna units 110(1)-110(4) may all have the same polarization orientation on the reflective element 114, or may have polarization orientations that vary a different amount than by 90 degrees between adjacent antenna units 110.

With respect to the 5 GHz antenna units, in the illustrated embodiment each antenna unit 112 includes three collocated, electrically isolated antenna elements 124, 126, 130 that are disposed on reflector element 114 and intersect with each other at a central antenna unit axis A2 that is normal to the reflector element 114 (e.g. the axis A2 extends in the vertical Z direction according to the coordinate system illustrated in the Figures). Antenna elements 124 and 126 are first and second dipole-type antennas that are rotated 90 degrees with respect to each other about the common central antenna unit axis A2. In the illustrated embodiment, the antenna element 118 is a monopole-type antenna that includes two legs 130A, 130B that intersect at right angles at the antenna unit axis A2. The monopole-type antenna element 130 is rotated 45 degrees about axis A2 relative to polarization directions of dipole antenna elements 124, 126. The three antenna elements provide three orthogonal polarizations, with the first and second dipole type antenna elements 124, 126 being configured to emit or receive RF signals in the horizontal X-Y plane in polarization directions that are directed at 90 degrees relative to each other, and the monopole type antenna element 130 being configured to emit or receive RF signals polarized in the vertical Z direction. Thus, first dipole antenna element 124 and the second dipole antenna element 126 are polarized in orthogonal directions generally parallel to the reflector element 114 and the monopole antenna element 130 is polarized in a direction that is orthogonal to the reflector element 114.

In the embodiment shown in FIGS. 1 and 2, each of the four 5 GHz antenna units 112(1) to 112(4) have similar orientations on the reflector element 114. However in other embodiments one or more of the units may have different polarization orientations such as noted above in respect of the 2.4 GHz antenna units 110.

Accordingly, in the illustrated embodiment, the antenna array 100 includes a total of eight independent antenna units, with four antenna units 110(1)-110(4) operating in a first frequency band (the 2.4 GHz band for example) and four antenna units 112(1)-112(4) operating in a second frequency band (the 5 GHz band for example), with each antenna unit 110, 112 having three collocated antenna elements each having a different directional polarization. In one embodiment, as shown in FIG. 1, each antenna unit 110, 112 is provided with its own conductive RF line RFL(1)-RFL(8), and switching between the antenna elements in each antenna unit is controlled by a antenna controller 140. Antenna controller 140 could for example include a microprocessor and a storage element that stores instructions that configure the microprocessor to operate.

Figure 3:
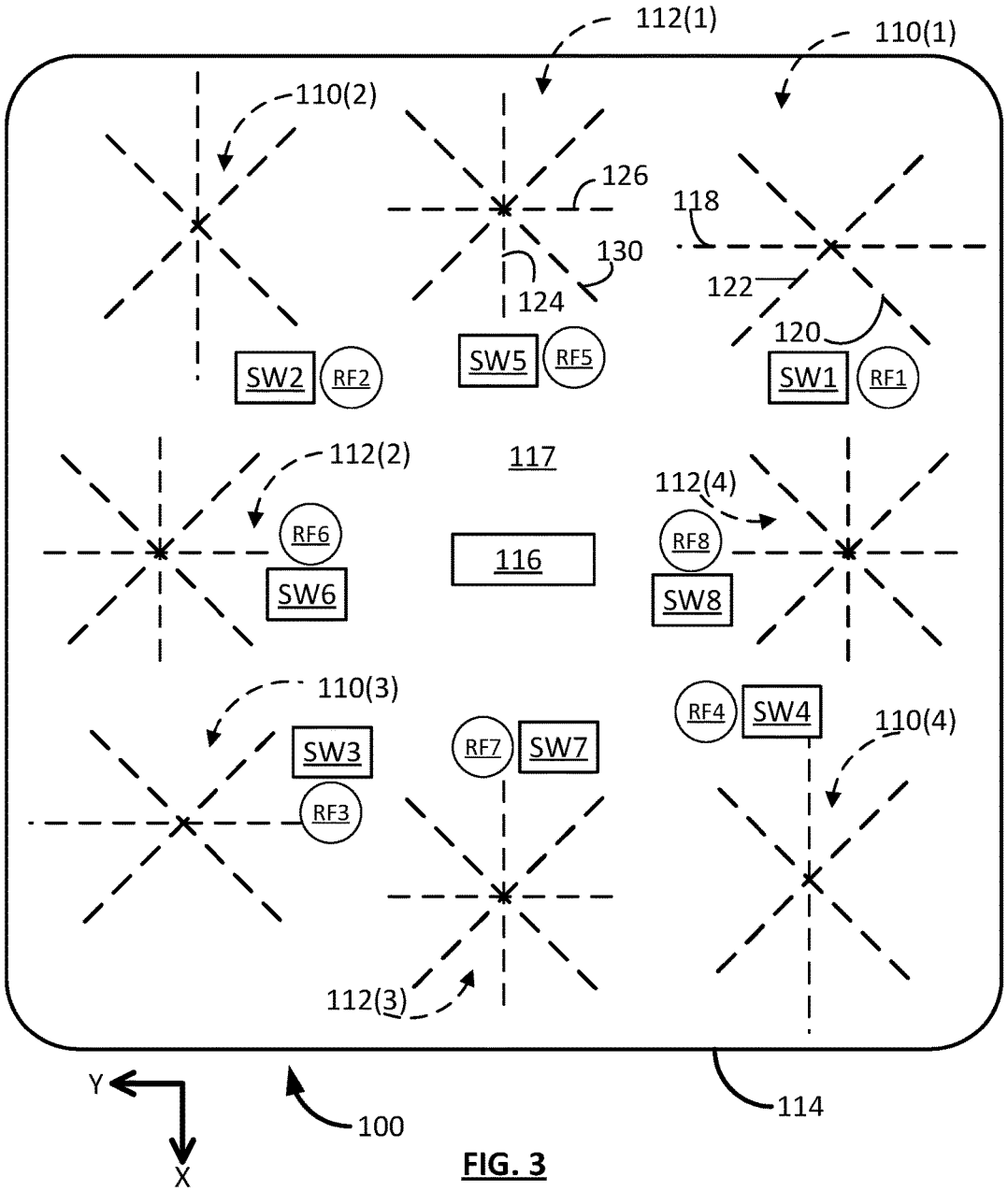
FIG. 3 is bottom plan view of the antenna array of FIG. 1

FIG. 3 shows a back surface 117 of the reflector element 114. In an example embodiment a plurality of single pole triple throw (1P3T) switches SW1 to SW8 and a switch interface 116 are mounted to conductive pads on the back surface 117 of reflector element 114. The back surface 117 of the reflector element 114 includes a non-conductive layer with conductive traces formed thereon between the switch interface 116 and each of the switches SW1 to SW8. The conductive traces, which are not shown in FIG. 3, provide a control and power signals to each of the switches SW1 to SW8. The switch interface 116, which is an integrated circuit chip in one embodiment, is connected to receive control signals from antenna controller 140, which are then distributed to the respective switches SW1 to SW8. RF interface elements RF1 to RF8 are also mounted to conductive pads on the back surface of reflector element 114, and are each connected to a respective RF line RFL(1) to RFL(8). The pole of each switch SW1 to SW8 is connected to a respective one of the RF interface elements RF1 to RF8, and the three throw terminals of each switch SW1 to SW8 are connected to the three antenna elements of a respective antenna unit 110(1) TO 110(4) and 112(1) to 112(4).

In example embodiments, RF lines RFL(1) to RFL(8) include conductive wires for exchanging RF signals with the respective antenna units that they are each associated with, and RF interface elements RF1 to RF8 each include a physical connector and an electrical connector for connecting to a respective RF line RFL(1) to RFL(8). In some example embodiments, RF lines RFL(1) to RFL(8) are coaxial lines and RF interface elements RF1 to RF8 include coaxial connectors.

Accordingly, in an example embodiment, switch SW1 can be selectively activated by switch controller 140 to connect RF line RFL1 to one of either antenna element 118, antenna element 120 or antenna element 122 of 2.4 GHz antenna unit 110(1). Similarly, switch SW2, SW3 and SW4 can be selectively activated by switch controller 140 to connect RF lines RFL2, RFL3 and RFL4 to the respective antenna elements of 2.4 GHz antenna units 110(2), 110(3) and 110(4), respectively. Regarding the 5 GHz antenna units, switch SW5 can be selectively activated by switch controller 140 to connect RF line RFL5 to one of either antenna element 124, antenna element 126 or antenna element 130 of 5 GHz antenna unit 112(1). Similarly, switch SW6, SW7 and SW8 can be selectively activated by switch controller 140 to connect RF lines RFL6, RFL7 and RFL8 to the respective antenna elements of 5 GHz antenna units 112(2), 112(3) and 112(4), respectively.

It will thus be appreciated the antenna array 100 can support up to 8 RF streams or channels, with 4 of the streams operating in a first frequency band and 4 of the streams operating in a second frequency band. Furthermore, each stream can be switched between three collocated antenna elements that have orthogonal polarizations, providing selectable polarization diversity. The RF streams can be incoming received streams or outgoing transmitted streams or combinations thereof. The combination of eight antenna units, each having three switch electable antenna elements, provides $3^8$=6581 possible different configurations for the antenna array 100, including 81 possible configurations for the 2.4 GHz band and 81 possible configurations for the 5 Ghz band.

The antenna units 110, 112 can take a number of different possible configurations. An example of a possible configuration for antenna unit 110 will be described in greater detail with reference to FIGS. 4 to 8B, and a possible configuration for antenna units 112 will be described in greater detail with reference to FIGS. 9 to 14B.

In example embodiments, the antenna elements 118, 120, 122, 124, 126, and the legs 130A, 130B of antenna element 130, are each formed from PCBs that include a dielectric substrate that support one or more conductive regions. In at least some example embodiments, the dielectric substrates may be 0.5 mm thick, although thicker and thinner substrates could be used. Conventional PCB materials such as those available under the Taconic™ or Arlon™ brands. In some examples, the dielectric substrates may be a thin film substrate having a thickness thinner than, in most cases, around 600 μm, or thinner than around 500 μm, although thicker substrate structures are possible. Typical thin film substrate materials may be flexible printed circuit board materials such as polyimide foils, polyethylene naphthalate (PEN) foils, polyethylene foils, polyethylene terephthalate (PET) foils, and liquid crystal polymer (LCP) foils. Further substrate materials include polytetrafluoroethylene (PTFE) and other fluorinated polymers, such as perfluoroalkoxy (PFA) and fluorinated ethylene propylene (FEP), Cytop® (amorphous fluorocarbon polymer), and HyRelex materials available from Taconic. In some embodiments the substrates are a multi-dielectric layer substrate.

Figure 4:
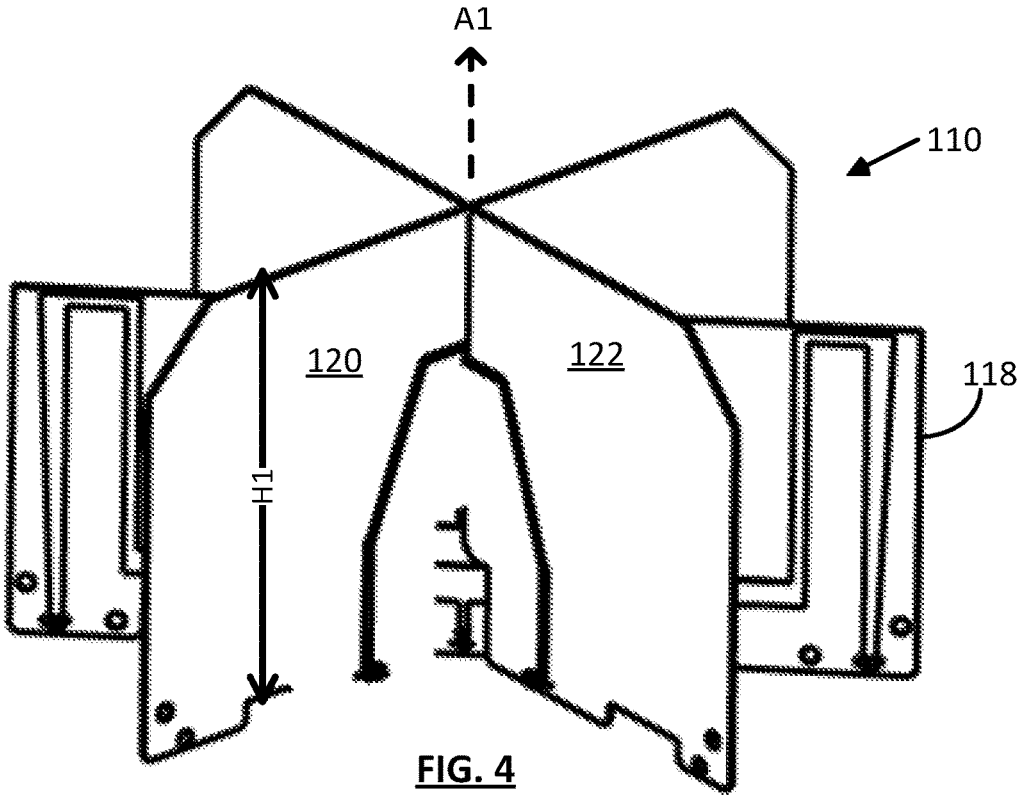
FIG. 4 is a perspective front view of a 2.45 GHz band antenna unit of the antenna array of FIG. 1.
Figure 5:
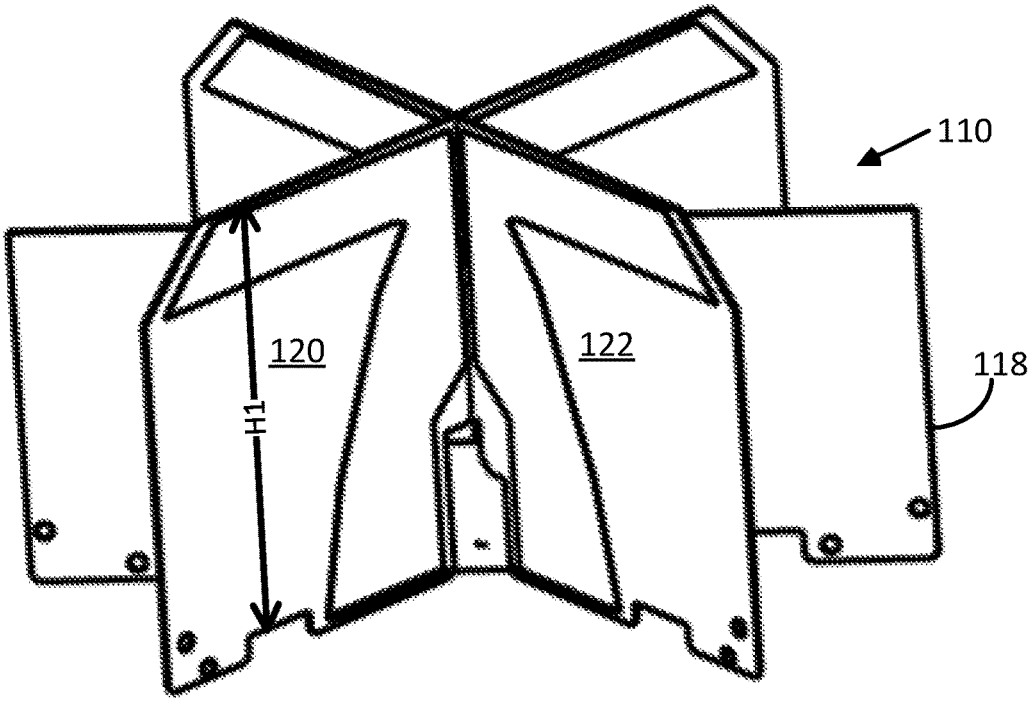
FIG. 5 is a perspective back view of the 2.45 Ghz band antenna unit of FIG. 4.

Referring to FIGS. 4 and 5, as noted above, in example embodiments the 2.4 GHz antenna unit 110 includes two dipole-style antenna elements 120, 122 and a monopole-style antenna element 118 that collectively provide three orthogonal polarization directions. The antenna elements 118, 120, 122 are co-located in that they each extend through and are bisected by a common central axis A1. In the illustrated example, the dipole antenna elements 120 and 122 meet at a right angle at the axis A1 with on dipole antenna element 118 rotated +45 degrees relative the monopole antenna element 118 and the other dipole antenna element rotated −45 degrees relative to the monopole antenna element 118 such that the monopole antenna element 118 symmetrically bisects the combined structure of dipole antenna elements 120 and 122. The first dipole antenna element 120 is configured to receive or emit an electromagnetic signal in a first polarization direction, the second dipole antenna element 122 is configured to receive or emit an electromagnetic signal in a second polarization direction that is in a common plane with and orthogonal to the first polarization direction, and the monopole antenna element 118 is configured to receive or emit an electromagnetic signal in a third polarization direction that is orthogonal to the common plane of the dipole antenna elements.

In example embodiments, each of the dipole antenna elements 120, 122 of each 2.4 Ghz antenna unit 110 extend a distance H1 from the reflector element 114, where H1≈$\lambda_1/4$ and $\lambda_1$ is the operating wavelength near the lower end of the 2.4 GHz frequency band (for example H1≈35 mm), and the monopole antenna element 118 has a height of about $\lambda_1/6$. Accordingly, in example embodiments the antenna unit 110 has a height that is about ¼ of the wavelength at lower end of the frequency band. In the illustrated example, the dipole antenna elements 120, 122 each have a width W1 (see FIGS. 6A and 7A) of about $\lambda_1/4$ (for example W1≈35 mm) and the monopole antenna element 118 has a width W2 of about $\lambda_1/2$ (for example W2≈59 mm). In some example embodiments, "about" can include a range of +/−15%.

Figure 6A:
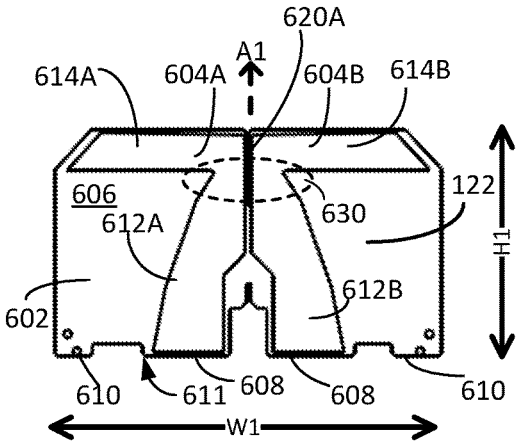
FIG. 6A is a back view of one dipole antenna element of the antenna unit of FIG. 4.
Figure 6B:
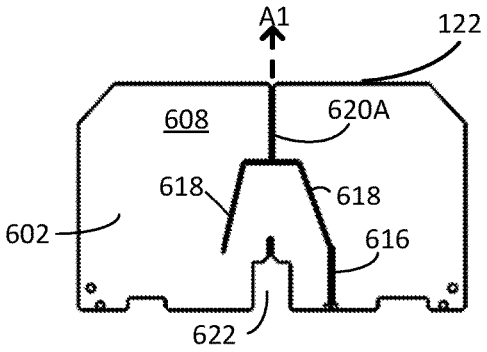
FIG. 6B is a front view of the dipole antenna element of FIG. 6A.
Figure 7A:
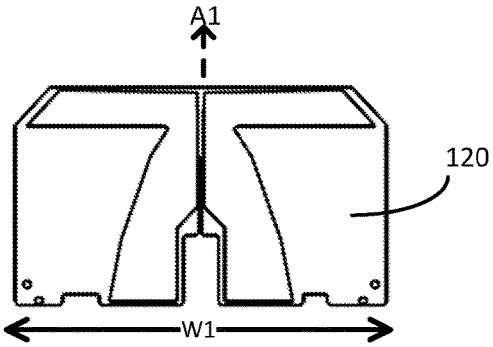
FIG. 7A is a back view of another dipole antenna element of the antenna unit of FIG. 4.
Figure 7B:
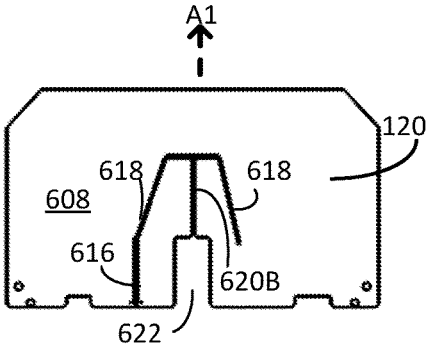
FIG. 7B is a front view of the dipole antenna element of FIG. 7A.

FIGS. 6A and 6B respectively show back and front surface views of the dipole antenna element 122, and FIGS. 7A and 7B respectively show back and front surface views of the dipole antenna element 120. The dipole element 122 has two conductive regions 604A, 604B that each include a respective dipole arm 614A, 614B and a respective leg 612A, 612B. Conductive regions 604A and 604B are formed on a surface 606 of the substrate 802 that is perpendicular to the front surface 115 of reflector element 114. The conductive regions 604A, 604B are bisymmetrical with respect to each other along antenna unit axis A1. The substrate 602 has mounting tabs 608, 610 formed along its back edge 611 for mating with corresponding slots that are formed in the reflector element 114. The legs 612A, 612B of the conductive regions 604A and 604B each extend along height H1 into respective tabs 608 for electrical connection to the ground plane of reflector element 114, and dipole e arms 614A, 614B extend across a half-width (½ W1) of the substrate surface 606. The upper ends of legs 612A, 612B and arms 614A, 614B are separated by a slot shaped void 120A that extends through the substrate 802 to facilitate collocation of the dipole elements 120, 122.

In the illustrated embodiment, a conductive connector 616 is provided as a feed point on the front surface 608 of the substrate 602. Connector 616 is electrically isolated from the ground plane of the reflector element 114 and is electrically connected to a throw terminal of a respective one of the switches SW1-SW4. The connector 616 is connected to a generally inverted "u" shaped microstrip trace 618 that extends on a portion of the surface 608 that is on the opposite side of the surface area where legs 612A, 612B are located. The trace 618 is separated from conductive leg regions 612A and 612B by the thickness of substrate 802 In example embodiments the trace 618 and connector 616 form a balun with an unbalanced 50Ω feed point. The separation gap between the trace 618 and conductive legs 612A and 612B provides a differential impedance for excitation of the unbalanced feedpoint. As highlighted by the ellipse labeled 630 in FIG. 6A, the dipole legs 612A, 612B both narrow at the region where they respectively meet dipole arms 614A, 614B. This narrowing region at defines the balanced feedpoint that excites the dipole arms 614A, 614B.

The conductive dipole regions 604A, 604B and the connector 616 and traces 618 may be formed from a conductive material such as copper or a copper alloy, or alternatively, aluminum or an aluminum alloy, that have been printed onto the substrate 602.

In the illustrated embodiment, the dipole element 120 is substantially identical to dipole element 122, except that, as can be seen by comparing FIGS. 6B and 7B, the feed connector 616 (which connects to a different throw terminal than the connector of antenna element 122 of a respective one of the switches SW1-SW4) is located on the opposite side of the front surface 608. Additionally, the dipole antenna element 122 includes slot shaped void 620A through substrate 602 that extends in one direction along axis A1, and the dipole antenna element 120 includes a similar slot shaped void 620B extending in the opposite direction along axis A1 to allow the two antenna elements 120, 122 to be slid together at right angles along axis A1. The dipole antenna elements 120, 122 also each include a downward opening central gap or void 622 between the dipole legs 612A, 612B to accommodate the monopole antenna element 118 at the common axis A1. When assembled, the first dipole antenna element 120 and the second dipole antenna element 122 form a combined structure in which the first dipole antenna element 120 and the second dipole antenna element 122 substantially bisect each other at the common antenna unit axis A1, and the monopole antenna element 118 substantially bisects the combined structure at the common antenna unit axis A1. The void 622 allows for placement of the monopole antenna element feedpoint connector 806 (described further below) at the symmetrical centre (i.e. along axis A1) of all three antenna elements 618, 620, 622. Such a configuration can, in at least some applications, optimize polarization orthogonality and element feed port isolations between the 3-collocated antenna elements 618, 620, 622.

Figure 8A:
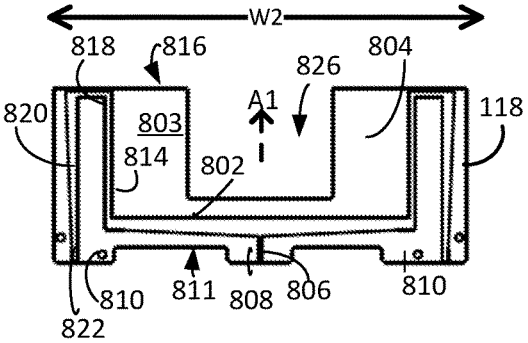
FIG. 8A is a front view of a monopole antenna element of the antenna unit of FIG. 4.
Figure 8B:
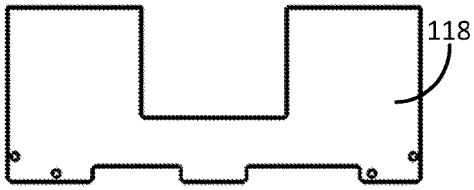
FIG. 8B is a back view of the monopole antenna element of FIG. 8A.
Figure 9:
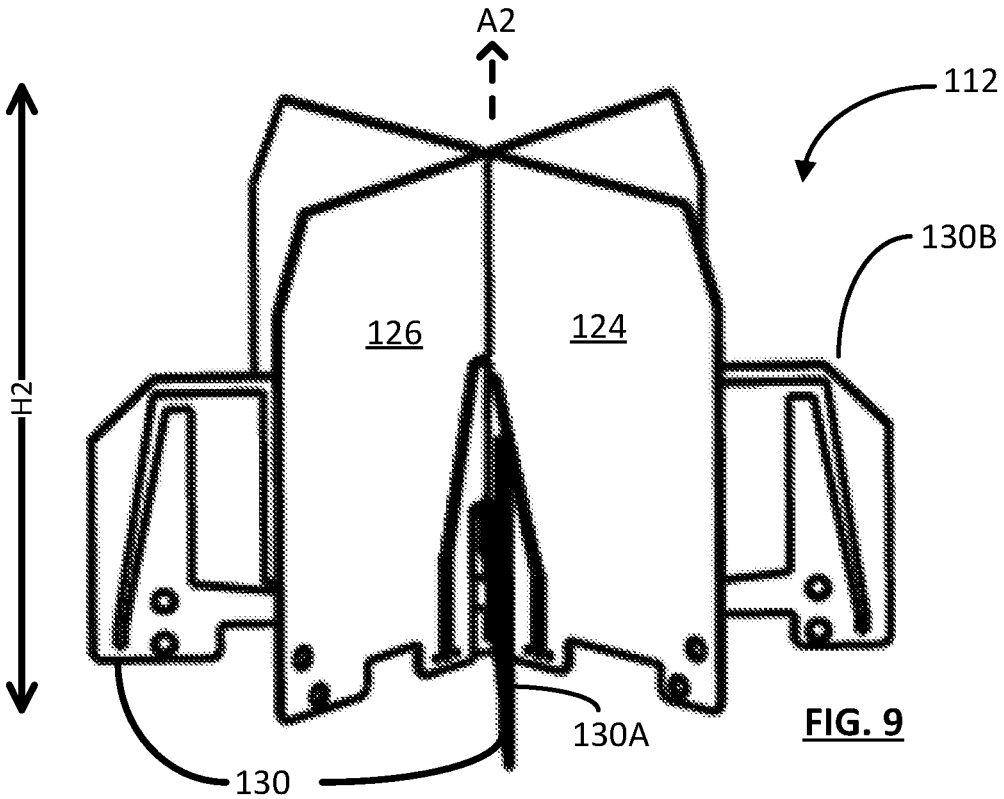
FIG. 9 is a perspective front view of a 5 GHz band antenna unit of the antenna array of FIG. 1.
Figure 10:
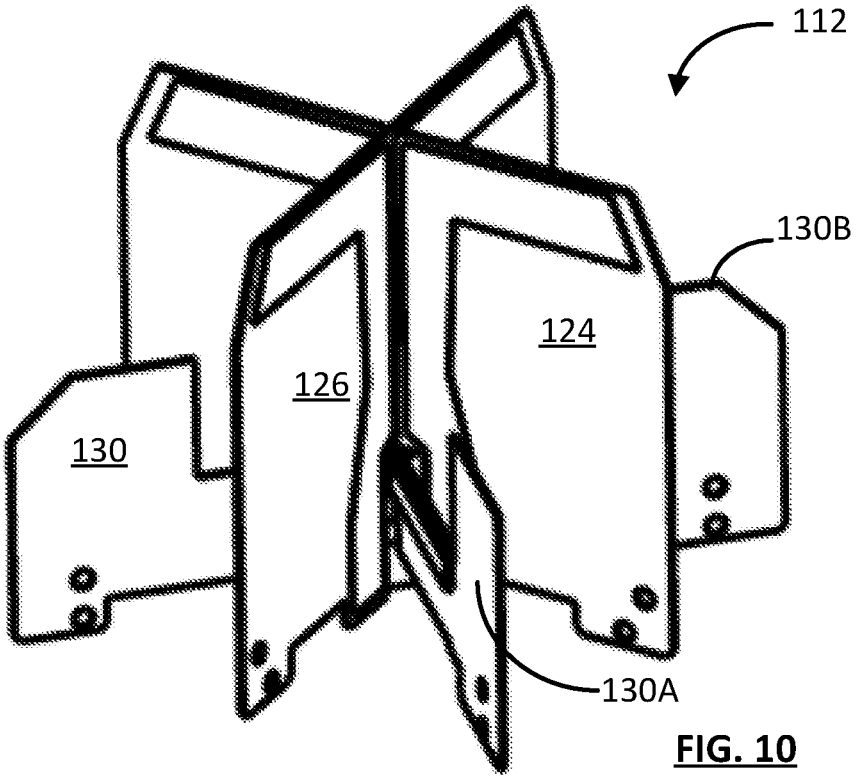
FIG. 10 is a perspective back view of the 5 Ghz band antenna unit of FIG. 9.
Figure 11A:
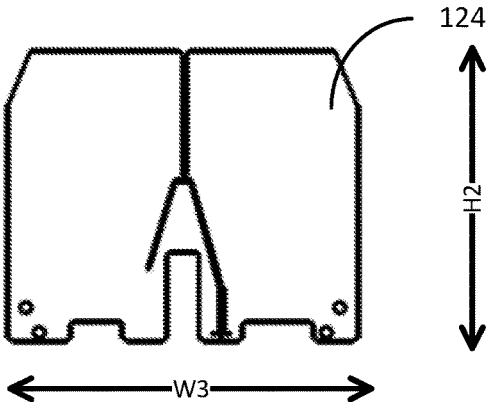
FIG. 11A is a front view of one dipole antenna element of the antenna unit of FIG. 9.
Figure 11B:
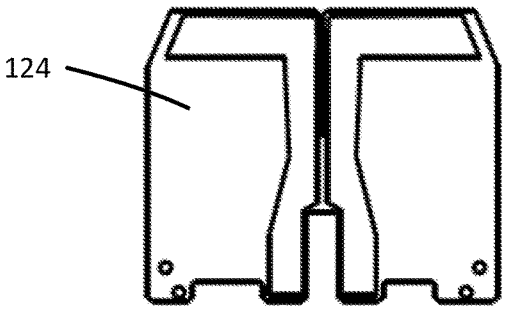
FIG. 11B is a back view of the dipole antenna element of FIG. 11A.
Figure 12A:
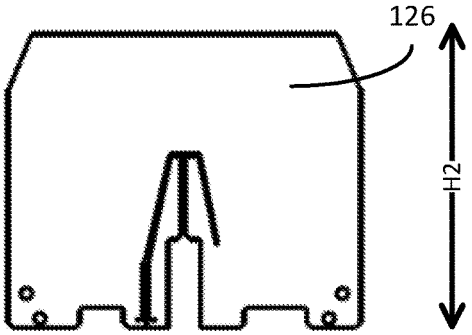
FIG. 12A is a front view of another dipole antenna element of the antenna unit of FIG. 9.
Figure 12B:
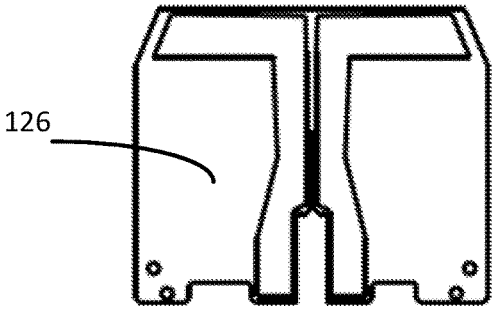
FIG. 12B is a back view of the dipole antenna element of FIG. 12A.
Figure 13A:
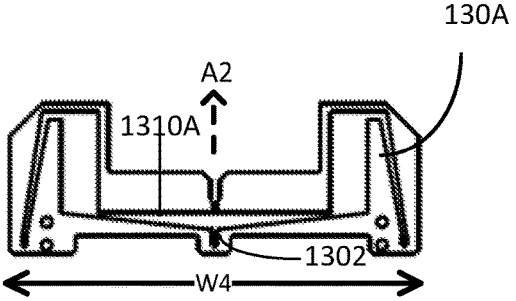
FIG. 13A is a front view of one leg of a monopole antenna element of the antenna unit of FIG. 9.
Figure 13B:
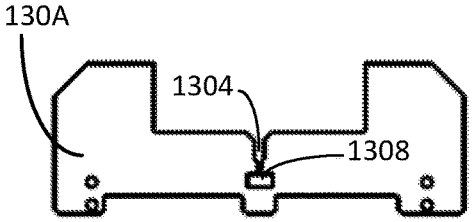
FIG. 13B is a back view of the monopole antenna element leg of FIG. 13A.
Figure 14A:
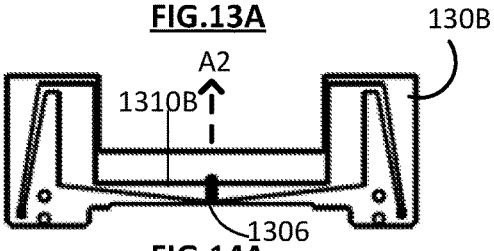
FIG. 14A is a front view of another leg of the monopole antenna element of the antenna unit of FIG. 9.
Figure 14B:
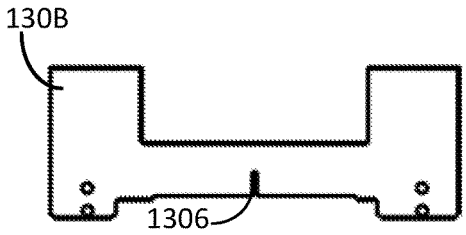
FIG. 14B is a back view of the monopole antenna element leg of FIG. 14A.

As disclosed in FIGS. 8*a*-8*b*, the monopole antenna element 118 is a folded monopole element, having a conductive pattern or region 802 formed on one side of a generally U-shaped dielectric substrate 804 that is bisymmetrical about antenna unit axis A1. The substrate has mounting tabs 808, 810 formed along its back edge 811 for mating with corresponding slots that are formed in the reflector element 114. The conductive region 802 is a conductive layer formed on a surface 803 of the substrate 804 that is perpendicular to the front surface 115 of reflector element 114. Conductive region 802 is connected to a central microstrip feedpoint connector 806 that is electrically isolated from the ground plane of the reflector element 114 and which electrically connects the conductive region 802 to a throw terminal of a respective one of the switches SW1-SW4. Conductive region 802 includes two identical portions that extend in opposite directions outward from central connector 806, with each portion including: a first elongate section 812 that extends along surface 803 generally parallel to back edge 811 to a second section 814 that extends at a right angle from the first section 812 towards a front edge 816 of the substrate 804 to a third section 818 that extends generally parallel to the front edge 816. The third section 818 extends to a fourth section 820 that folds back to extend from the front edge 816 to the back edge 811 of the substrate 804. In an example embodiment a terminal end 822 of the fourth section 820 is electrically connected to the ground plane of the reflector element 114. Accordingly, in an example embodiment, monopole antenna element 118 includes two conductive loops that each include a section 814 that extends outward from the conductive element 114 to a distance of about $\lambda_1/4$ and a further section 820 that extends back to the conductive element 114. The substrate 803 includes an upward opening central gap 826 for accommodating the dipole antenna elements 120, 122 along the common axis A1.

The conductive region 802 and connector 806 may be formed from a conductive material such as copper or a copper alloy, or alternatively, aluminum or an aluminum alloy, that have been printed onto the substrate 803.

As noted above, an example of a 5 GHz antenna unit 112 is shown in greater detail in FIGS. 9 to 14B. Other than dimensions, in the illustrated embodiment the dipole antenna elements 124 and 126 of the 5 Ghz antenna unit 112 are substantially identical to the dipole antenna elements 120 and 122 of the 2.4 Ghz antenna unit 110 described above. In example embodiments, each of the dipole antenna elements 124, 126 of each 5 Ghz antenna unit 112 extend a distance H2 from the reflector element 114, where H2≈$\lambda_2/2$ and $\lambda_2$ is the operating wavelength near the lower end of the 5 Hz frequency band (for example H2≈35 mm), and the two legs 130A, 130B of the monopole antenna element 118 each have a height of about $\lambda_2/6$. Accordingly, in example embodiments the antenna unit 112 has an overall height that is about ½ of the wavelength at lower end of the 5 GHz frequency band. In the illustrated example, the dipole antenna elements 124, 125 each have a width W3 (see FIGS. 11A and 12A) of about $\lambda_2/2$ (for example W3≈35 mm) and the two legs 130A, 130B of the monopole antenna element 130 each also have a width W4 of about $\lambda_2/2$ (for example W2≈35 mm). As indicated above, in some example embodiments, "about" can include a range of +/−15 The dimensions described in this application for the various elements of the antenna array 100 are non-exhaustive examples and many different dimensions can be applied depending on both the intended operating frequency bands and physical packaging constraints.

As noted above and as can be seen in FIGS. 9, 10, and 13A-14B, in the illustrated embodiment the monopole antenna element 130 of 5 GHz antenna unit 112 differs from the monopole antenna element 118 of 2.4 GHz antenna unit 110 in that the monopole antenna element 130 includes 2 monopole legs 130A and 130B instead of just the a single monopole leg. In an example embodiment the configuration of each of the monopole legs 130A, 130B is similar to the configuration of the monopole antenna element 118 of 2.4 GHz antenna unit 110, except for differences that will be apparent from the figures and the following description. Monopole legs 130A, 130B each have a respective conductive region 1310A, 1310B that is similar to the conductive region 802 provided on monopole antenna element 118. Furthermore, monopole leg 130A includes a feed connector 1302 similar to the connector 806 of monopole antenna element 118, for connection to the throw terminal of a corresponding 1P3T switch SW5-SW8.

However, first monopole leg 130A also includes a conductive pad 1308 on its reverse surface that is electrically connected to conductive region 1310A, and an upwardly opening slot 1304 along central axis A2 for receiving a portion of the second monopole leg 103B. Second monopole leg 130B has a corresponding downwardly opening slot 1306 along central axis A2 for receiving a portion of the first monopole leg. When the monopole legs 130A and 130B are connected at 90 degree angle along axis A2, the conductive regions 1310A, 1310B are located at right angles to each other and are bisected along axis A2. One half of the second monopole conductive region 1310B is electrically and physically connected (for example by solder) to the conductive region 1310A, and the other half of the second monopole conductive region 1310B is electrically and physically connected (for example by solder) to the conductive pad 1308, such that both legs 130A, 130B are electrically connected to feed connector 1306.

When antenna unit 112 is assembled, the first dipole antenna element 124 and the second dipole antenna element 126 form a combined structure in which the first dipole antenna element 124 and the second dipole antenna element 126 substantially bisect each other at the common antenna unit axis A2, and the monopole antenna element 126 substantially bisects the combined structure at the common antenna unit axis A2.

In at least some configurations, embodiments of the antenna array 100 can advantageously accomplish one of more of the following: increase the capacity of a MIMO antennal; efficiently use available real estate and space; reduce the size of an antenna required; and detect a wide range of RF signals.

Figure 15:
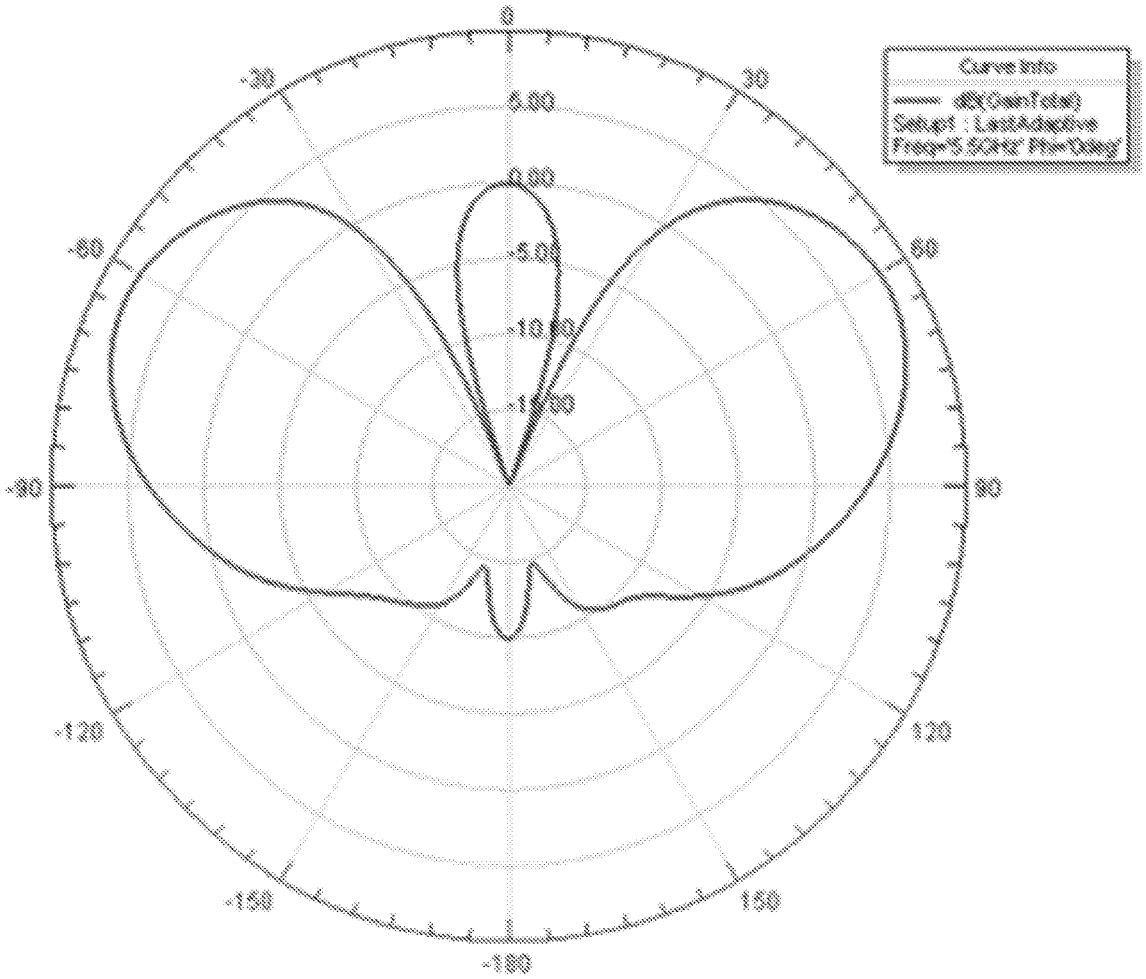
FIG. 15 shows an example of E-plane radiation pattern for dipole antenna elements of the antenna unit of FIG. 9.
Figure 16:
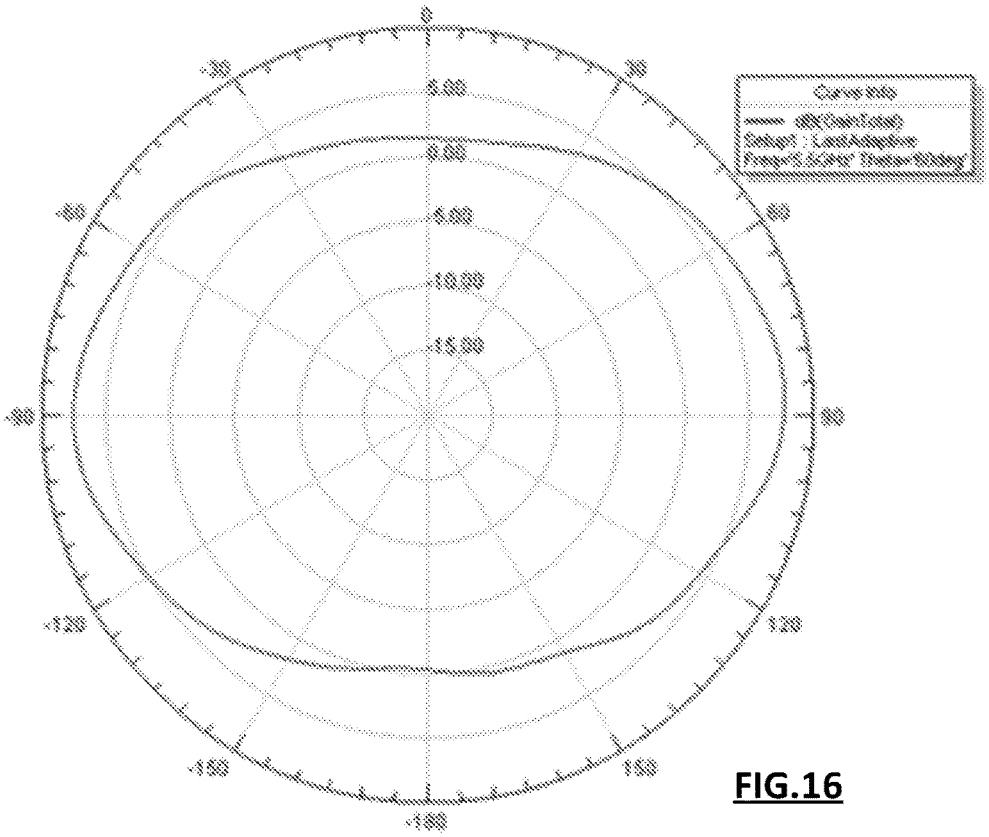
FIG. 16 shows an example H-plane linear X-polarization radiation pattern for a dipole antenna element of the antenna unit of FIG. 9.
Figure 17:
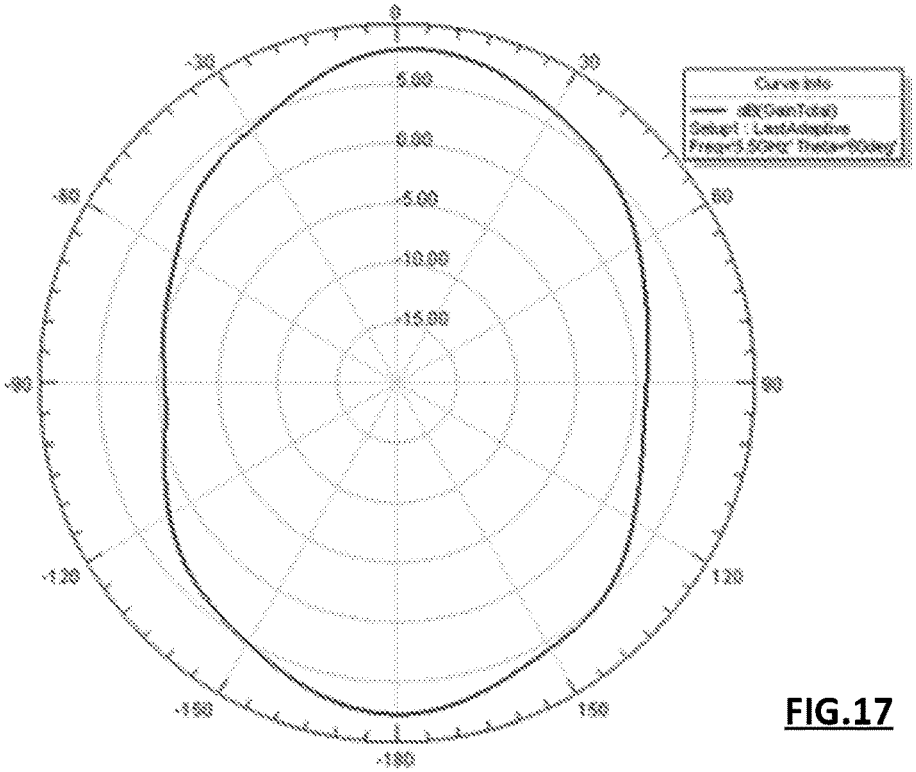
FIG. 17 shows an example H-plane linear Y-polarization radiation patterns for a dipole antenna element of the antenna unit of FIG. 9.
Figure 18:
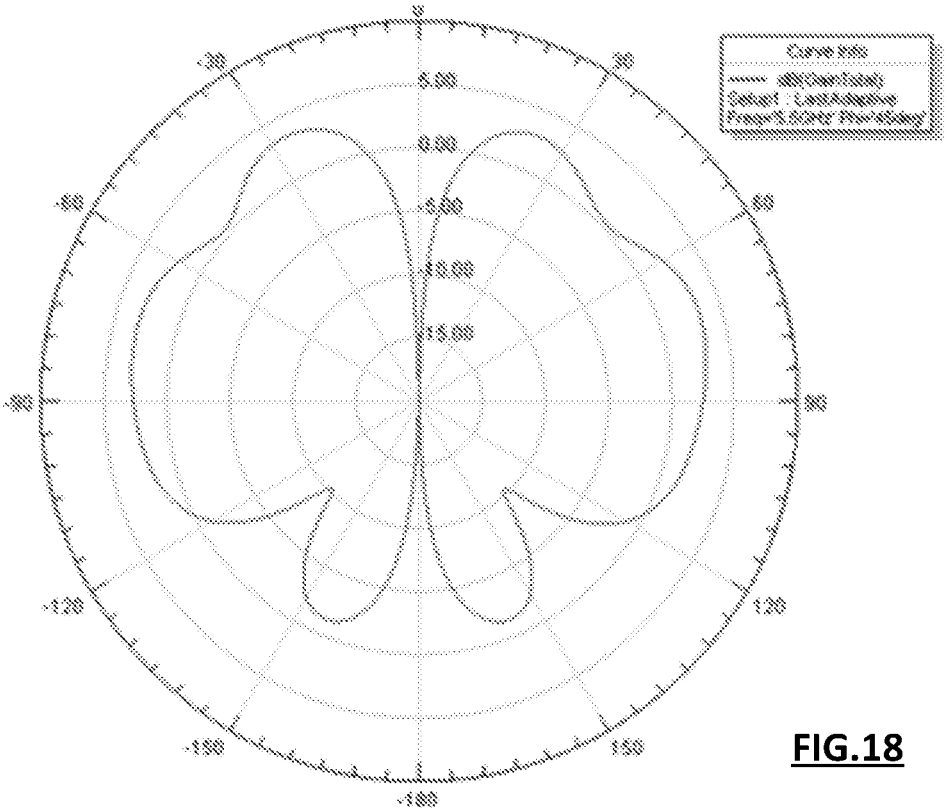
FIG. 18 shows an example of an E-plane radiation pattern for a monopole antenna element 130 of the antenna unit of FIG. 9.
Figure 19:
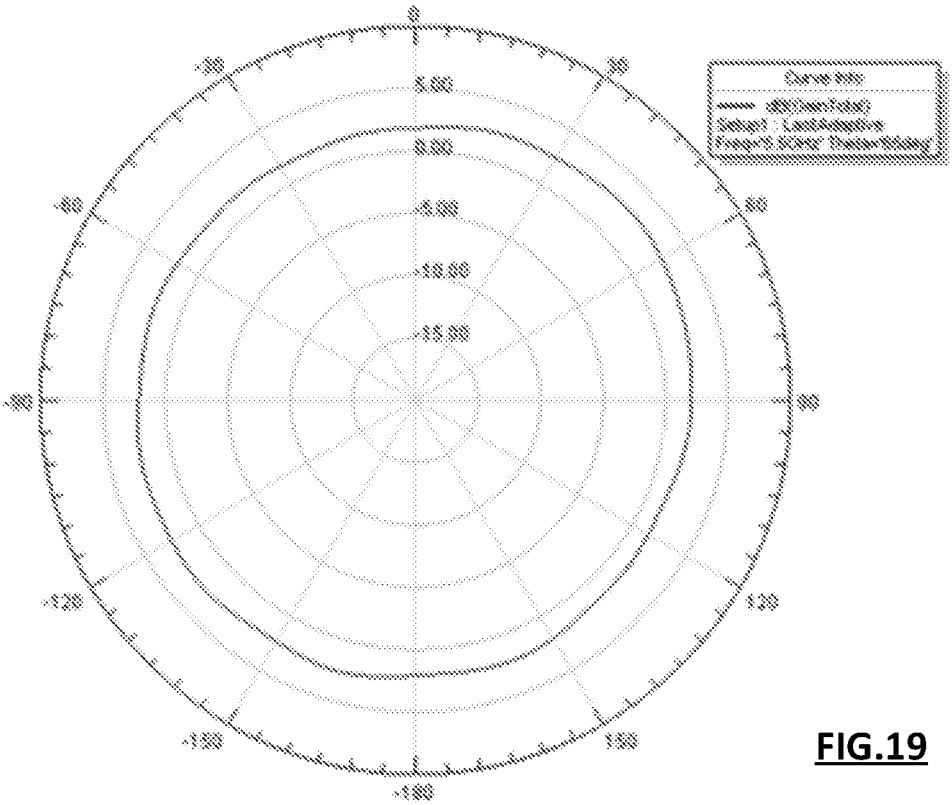
FIG. 19 shows an example of a H-plane linear Z-polarization radiation pattern for a monopole antenna element 130 of the antenna unit of FIG. 9.

FIGS. 15 to 19 an example radiation patterns for each of the individual antenna elements of a 5 GHz antenna unit 112. In particular: FIG. 15 shows an example of E-plane radiation pattern for each of the dipole antenna elements 124, 126; FIGS. 16 and 17 respectively show H-plane linear X-polarization and linear Y-polarization radiation patterns for the dipole antenna elements 124, 126; FIG. 18 shows an example of E-plane radiation pattern for monopole antenna element 130; and FIG. 19 shows an H-plane linear Z-polarization radiation pattern for the monopole dipole antenna element 130.

Figure 20:
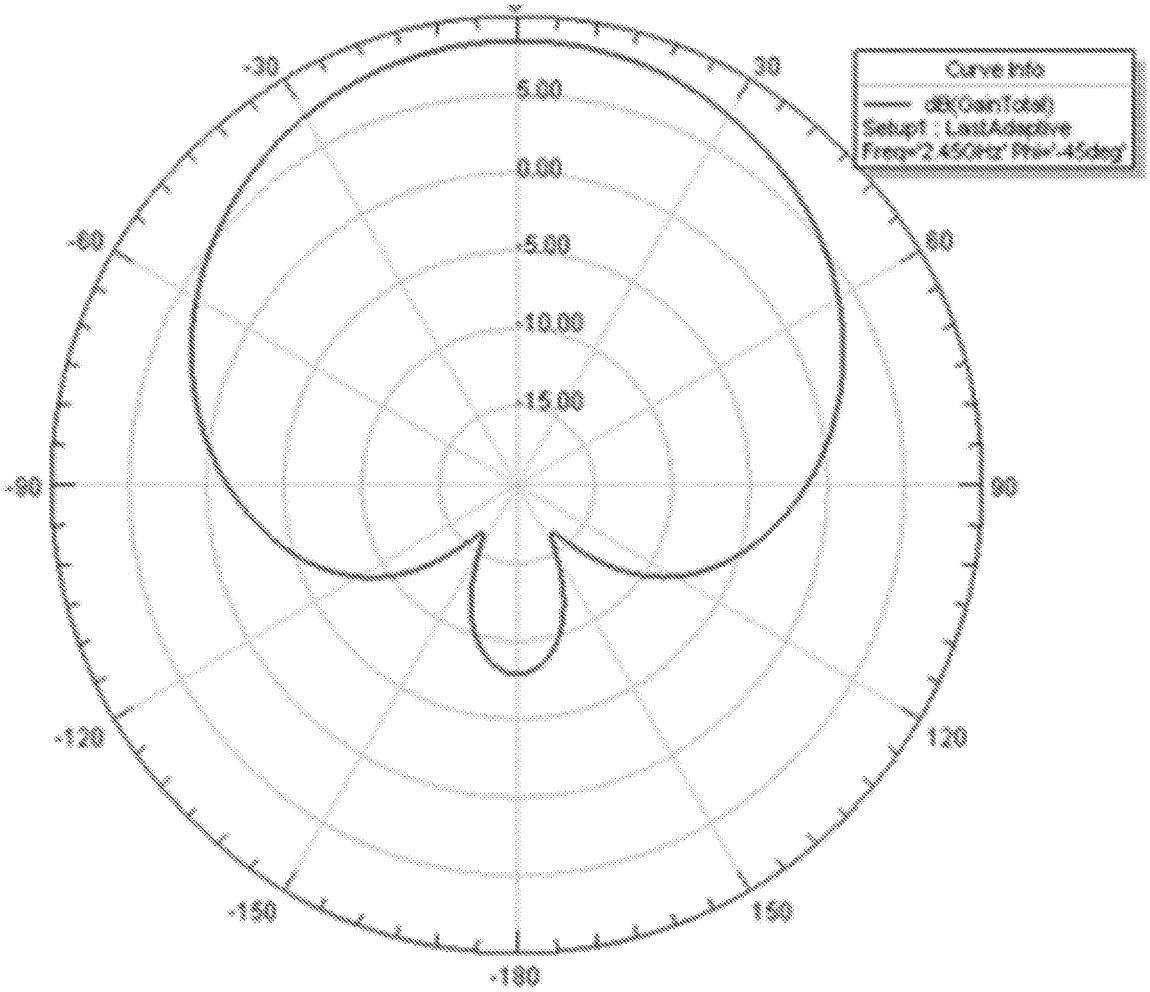
FIG. 20 shows an example of E-plane radiation pattern for a dipole antenna elements of the antenna unit of FIG. 4.
Figure 21:
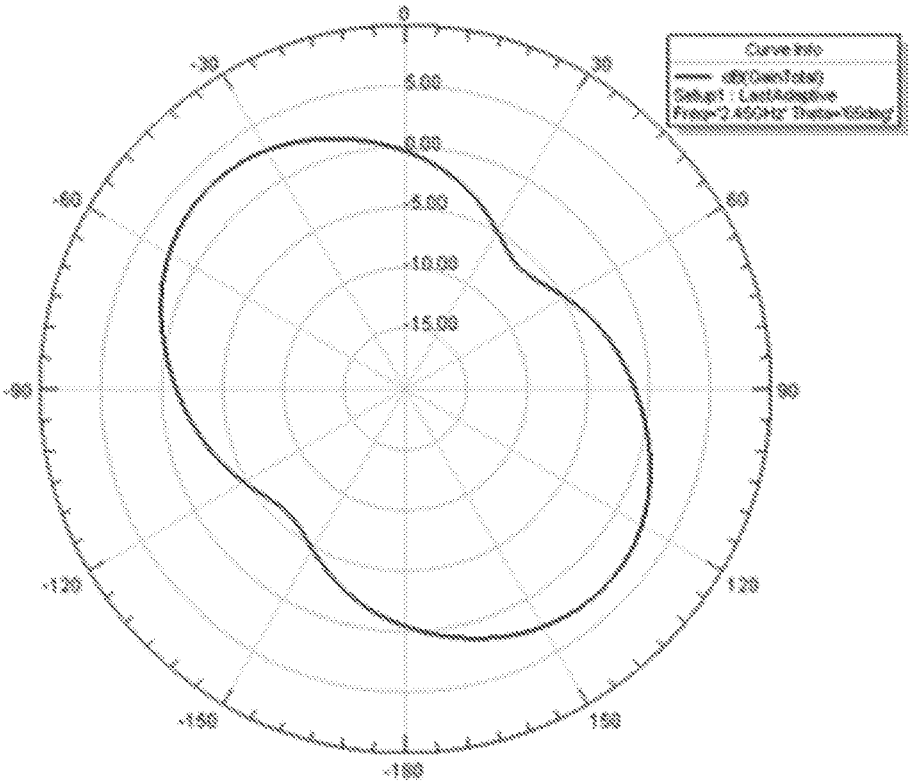
FIG. 21 shows an example H-plane linear X-polarization radiation pattern for a dipole antenna element of the antenna unit of FIG. 4.
Figure 22:
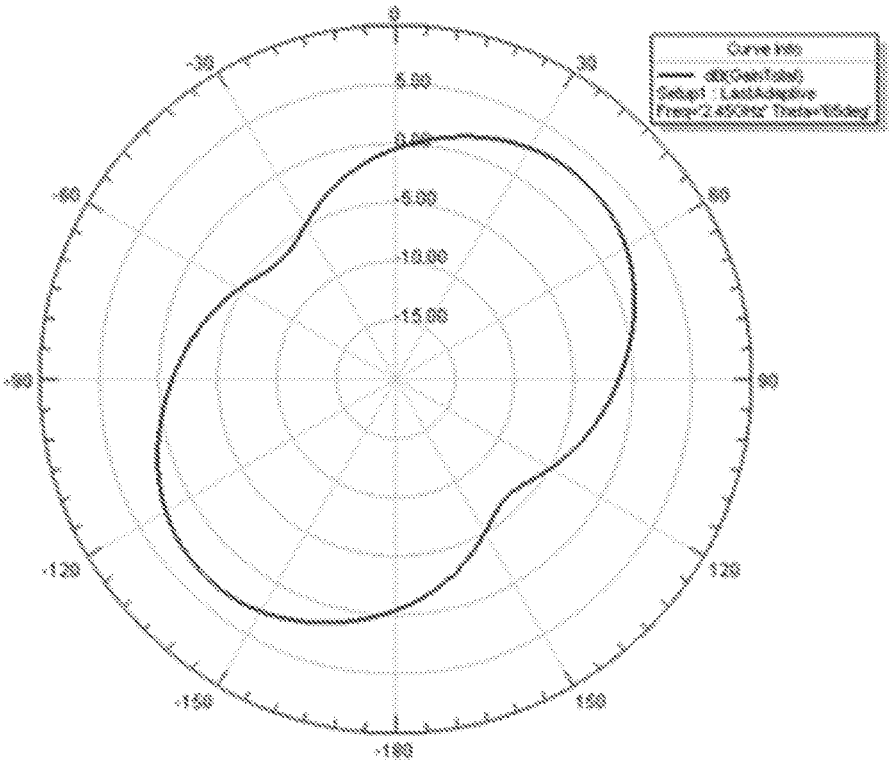
FIG. 22 shows an example H-plane linear Y-polarization radiation pattern for a dipole antenna element of the antenna unit of FIG. 4.
Figure 23:
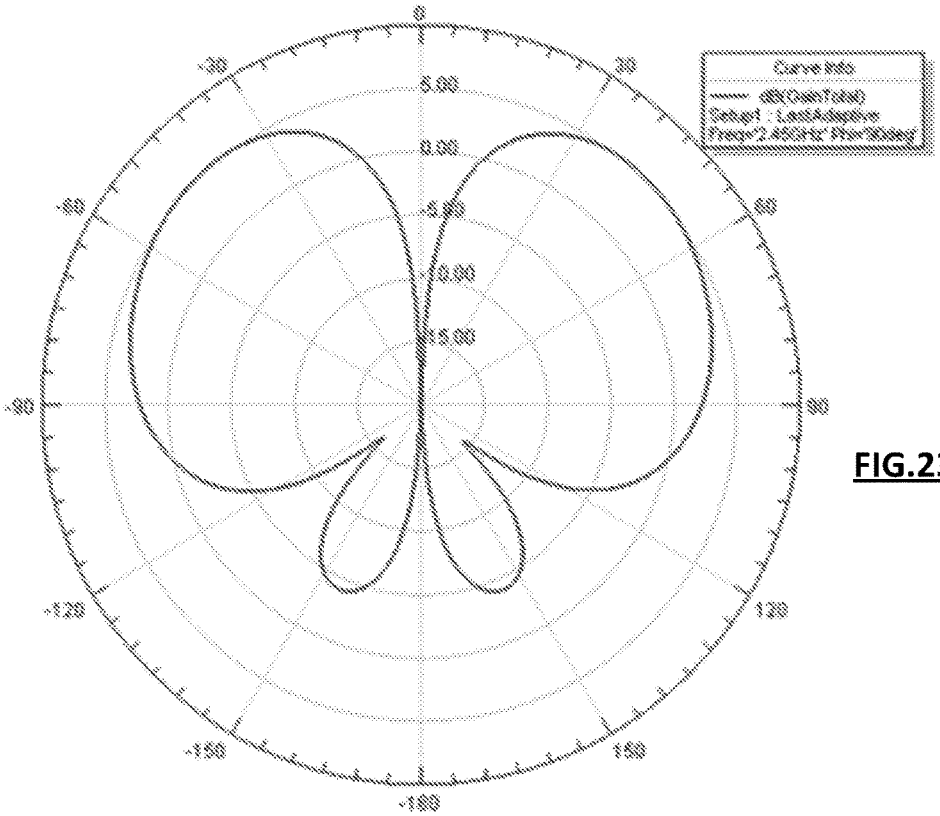
FIG. 23 shows an example E-plane radiation pattern for a monopole antenna element of the antenna unit of FIG. 4.
Figure 24:
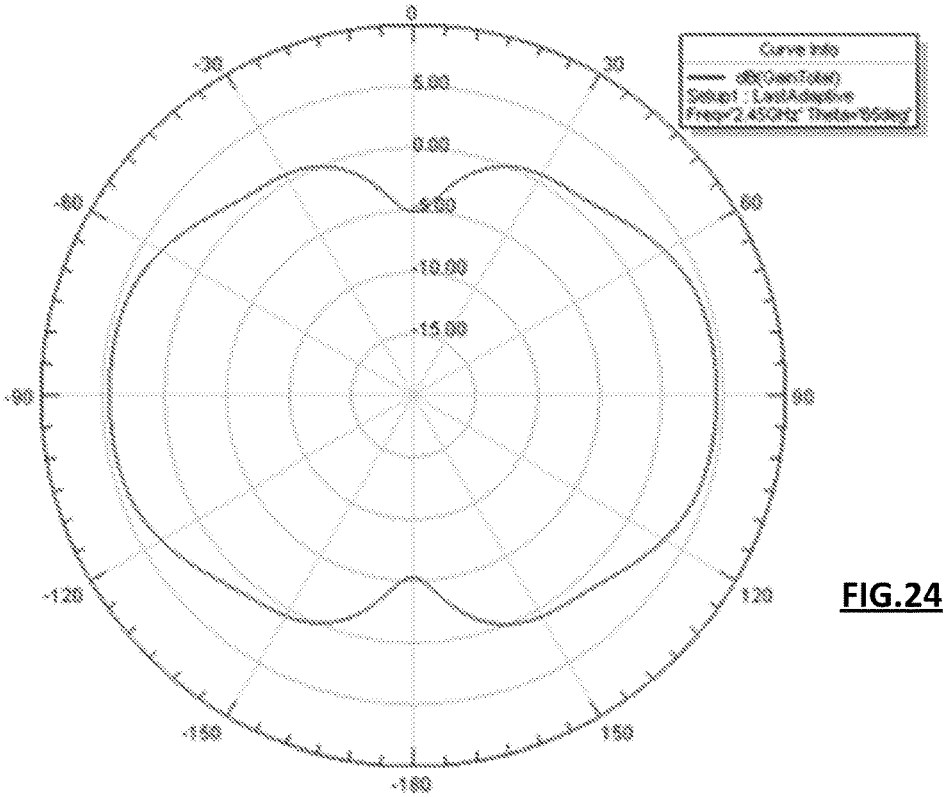
FIG. 24 shows an example H-plane linear Z-polarization radiation pattern for a monopole dipole antenna element of the antenna unit of FIG. 4.

FIGS. 20 to 24 an example radiation patterns for each of the individual antenna elements of a 2.4 GHz antenna unit 110. In particular: FIG. 20 shows an example of E-plane radiation pattern for each of the dipole antenna elements 120, 122; FIGS. 21 and 22 respectively show H-plane linear X-polarization and linear Y-polarization radiation patterns for the dipole antenna elements 120, 122; FIG. 23 shows an example of E-plane radiation pattern for monopole antenna element 118; and FIG. 24 shows an H-plane linear Z-polarization radiation pattern for the monopole dipole antenna element 118.

Any one of the three linear, orthogonal radiation polarizations (X, Y, or Z linear) are independently selectable on any stream. Embodiment of the invention may be applied to radar system such as automotive radar or telecommunication applications such as transceiver applications in base stations or user equipment (e.g., hand held devices).

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A radio frequency (RF) antenna array comprising:

a reflector element;

a first antenna unit that operates at a first frequency band and includes three antenna elements that are collocated on the reflector element, each of the three antenna elements having a polarization direction that is orthogonal to polarization directions of the other two antenna elements of the first antenna unit;

a first switch associated with the first antenna unit and a first conductive line for selectively connecting each one of the antenna elements of the first antenna unit to the first conductive line;

a second antenna unit that operates at a second frequency band and includes three antenna elements that are collocated on the reflector element, each of the three antenna elements having a polarization direction that is orthogonal to polarization of the other two antenna elements of the second antenna unit; and a second switch associated with the second antenna unit and a second conductive line for selectively connecting each one of the antenna elements of the second antenna unit to the second conductive line.

2. The antenna array of claim 1 comprising:

a plurality of the first antenna units, and a plurality of the first switches, each of the first switches being associated with a respective one of the first antenna units and a respective first conductive line; and a plurality of the second antenna units, and a plurality of the second switches, each of the second switches being associated with a respective one of the second antenna units and a respective second conductive line.

3. The antenna array of claim 1 wherein the first antenna units alternate with second antenna units around a central area of the reflector element.

4. The antenna array of claim 3 wherein the first and second antenna units are generally symmetrically located around the central area.

5. The antenna array of claim 1 wherein the first and second antenna units are each disposed on a first surface of the reflector element and the first switches and second switches are each disposed on a second surface that faces an opposite direction than the first surface, the second surface having a plurality of interfaces disposed thereon connecting the first and second conductive lines to the first and second switches.

6. The antenna array of claim 1 wherein at least some of the first antenna units have different polarization orientations on the reflector element than at least some of the other first antenna units.

7. The antenna array of claim 6 wherein at least some of the second antenna units have a same polarization orientation on the reflector element as some of the other second antenna units.

8. The antenna array of claim 1 wherein the first frequency band is a 2.4 GHz band and the second frequency band is a 5 GHz band.

9. The antenna array of claim 1 wherein the antenna elements of each of the first antenna unit and the second antenna unit comprise:

a first dipole antenna element;

a second dipole antenna element; and a monopole antenna element;

the first dipole antenna element, second dipole antenna element and monopole antenna element intersecting at a common antenna unit axis.

10. The antenna array of claim 9, wherein for each of the first antenna units and the second antenna units:

the first dipole antenna element and the second dipole antenna element are polarized in orthogonal directions generally parallel to the reflector element; and the monopole antenna element is polarized in a direction that is orthogonal to the reflector element.

11. The antenna array of claim 10 wherein for each of the first antenna units and the second antenna units:

the first dipole antenna element and the second dipole antenna element form a structure in which the first dipole antenna element and the second dipole antenna element substantially bisect each other at the common antenna unit axis; and the monopole antenna element substantially bisects the structure at the common antenna unit axis.

12. The antenna array of claim 11 wherein for at least one of the first and second antenna units the monopole antenna element comprises first and second monopole legs that intersect at the common antenna unit axis, the monopole legs each being connected to a common switch terminal and each having a substantially identical conductive region formed on a surface thereof.

13. A radio frequency (RF) antenna apparatus comprising:

a reflector element;

a set of first interface elements disposed on the reflector element for exchanging RF signals with a set of first conductive wires;

a set of first antenna units that operate at a first frequency band disposed on the reflector element, each first antenna unit being associated with a respective one of the first conductive wires and comprising three intersecting antenna elements that: (i) are each individually connectable to the first conductive line associated with the first antenna unit; and (ii) each have a polarization direction that is orthogonal to polarization directions of the other two antenna elements;

a set of second interface elements disposed on the reflector element for exchanging RF signals with a set of second conductive wires; and a set of second antenna units that operate at a second frequency band disposed on the reflector element, each second antenna unit being associated with a respective one of the second conductive wires and comprising three intersecting antenna elements that: (i) are each individually connectable to the second conductive line associated with the second antenna unit; and (ii) each have a polarization direction that is orthogonal to polarization directions of the other two antenna elements.

14. The antenna apparatus of claim 13 wherein the first antenna units alternate with second antenna units around a central area on a first surface of the reflector element, and the first and second interface elements are disposed on a second surface that faces an opposite direction than the first surface.

15. The antenna apparatus of claim 13 wherein the first antenna units all have different polarization orientations on the reflector element than the other first antenna units and the second antenna units all have the same polarization orientation on the reflector element.

16. The antenna apparatus of claim 13 wherein the first frequency band is a 2.4 GHz band and the second frequency band is a 5 GHz band.

17. The antenna apparatus of claim 13 wherein the antenna elements of each of the first antenna unit and the second antenna unit comprise:

a first dipole antenna element;

a second dipole antenna element; and a monopole antenna element;

the first dipole antenna element, second dipole antenna element and monopole antenna element intersecting at a common antenna unit axis.

18. The antenna apparatus of claim 17, wherein for each of the first antenna units and the second antenna units:

the first dipole antenna element and the second dipole antenna element are polarized in orthogonal directions generally parallel to the reflector element; and the monopole antenna element is polarized in a direction that is orthogonal to the reflector element.

19. The antenna apparatus of claim 17 wherein for each of the first antenna units and the second antenna units:

the first dipole antenna element and the second dipole antenna element form a structure in which the first dipole antenna element and the second dipole antenna element substantially bisect each other at the common antenna unit axis; and the monopole antenna element substantially bisects the structure at the common antenna unit axis.

20. The antenna apparatus of claim 19 wherein for at least one of the first and second antenna units the monopole antenna element comprises first and second monopole legs that intersect at the common antenna unit axis, the monopole legs each having a substantially identical conductive region formed on a surface thereof.

21. The antenna apparatus of claim 19 wherein for each of the first antenna units and the second antenna units the monopole antenna element has a feedpoint that is located along the common antenna unit axis.

* * * * *